US005924652A

United States Patent [19]

Ballinger

[11] Patent Number: 5,924,652

[45] Date of Patent: Jul. 20, 1999

[54] ISLAND PRESENCE DETECTED

[75] Inventor: Forrest H. Ballinger, Grain Valley, Mo.

[73] Assignee: Harmon Industries, Inc., Blue Springs, Mo.

[21] Appl. No.: 08/939,777

[22] Filed: Sep. 29, 1997

[51] Int. Cl.[6] ..... B61L 1/00

[52] U.S. Cl. ..... 246/126; 246/34 R; 246/126; 246/127; 246/128; 246/255; 246/246; 246/249

[58] Field of Search ..... 246/34 R, 34 A, 246/34 B, 34 CT, 122 R, 125, 126, 127, 128, 129, 218, 219, 246, 249, 255, 130

[56] References Cited

U.S. PATENT DOCUMENTS

| | | | |
|---|---|---|---|
| 3,622,110 | 11/1971 | Campbell . | |
| 3,706,098 | 12/1972 | Geiger . | |
| 3,777,139 | 12/1973 | Peel . | |
| 3,781,542 | 12/1973 | Brockman | 246/125 |
| 3,944,173 | 3/1976 | Moe et al. . | |
| 3,977,634 | 8/1976 | Smith . | |
| 4,062,294 | 12/1977 | Cohen . | |
| 4,307,860 | 12/1981 | Kuhn . | |
| 4,365,777 | 12/1982 | Geiger | 246/130 |
| 4,581,700 | 4/1986 | Farnham et al. . | |
| 4,619,425 | 10/1986 | Nagel | 246/34 R |
| 4,868,538 | 9/1989 | Ballinger et al. | 246/34 A |
| 5,170,970 | 12/1992 | Ballinger . | |
| 5,417,388 | 5/1995 | Stillwell | 246/122 R |

*Primary Examiner*—Mark T. Le
*Attorney, Agent, or Firm*—Chase & Yakimo, L.C.

[57] ABSTRACT

A reliable and consistent electrical contact path between the rails of a section of railroad track established by the shunting effect of the wheels and axles of a train is ensured by applying time-spaced, short duration electrical pulses to the rails at a voltage level sufficient to overcome poor wheel/rail contact. Each of the pulses is produced by a generator that discharges a capacitor across the rails. The narrow pulse width inductively isolates the pulse generator and associated track section from adjacent stretches of track, and the spacing between pulses further avoids interference with other types of electrical track equipment. A detector responsive to the voltage on the rails disables the pulse generator when the received voltage exceeds a threshold and thus indicates that no train wheels are present in the track section. In a grade crossing warning system, once activated the pulse generator and detector assume the role of the island detection circuit and maintain the crossing warning.

15 Claims, 2 Drawing Sheets

ISLAND PRESENCE DETECTED

BACKGROUND OF THE INVENTION

This invention relates to a method and apparatus for improving detection of the presence of the wheels of a train in a predetermined stretch of railroad track by ensuring that an effective shunt is maintained across the rails and, in particular, to the utilization of a normally inactive, high-voltage pulse generator which is connected to the rails and enabled when a train is present, and an associated receiver that disables the generator when train wheels are no longer present.

The shunt effect caused by the metallic wheels and axles of a railroad train is an important characteristic which is relied upon in the design and practical utilization of control systems for railroads. Since the shunt is a short circuit across the rails where a train is located, the change in track impedance which results when a train approaches, as seen, for example, from a grade crossing may be used to detect the motion of the train at a distance from the crossing and activate appropriate highway-rail grade crossing warning devices such as flashing lights and/or gates to warn vehicular traffic when the train enters a designated area on either side of the crossing. When the train reaches the grade crossing, typically a separate island detector then assumes a presence detection function to continue the warning system in operation during the time that the train is physically present in the crossing. Therefore, the effective and consistent establishment of a shunt across the rails by the wheels and axles of the train is vital to the operation of the warning system.

In recent years, a number of developments intended to improve rolling efficiency have made it increasingly difficult to rely upon a consistent shunt. Changes in railhead contours caused by milling the edge of the rail (reducing the normal scrubbing between the wheel and the railhead), wheel oiling to reduce rolling friction, and articulated cars with reduced axle counts all impair the establishment of a consistent shunt. Also, oxide buildup (rust) on the top of the rail reduces normal rail/wheel contact. Therefore, both physical changes and the presence of contaminates provide a potential of reducing electrical contact to the point where grade crossing warning systems, which are activated by this contact, may at times be inappropriately deactivated even though a train still occupies the island section of the highway-rail grade crossing warning circuit.

It has been proposed heretofore to apply an additional 60 Hz alternating current to the track for the purpose of breaking through films and oxides which may be present in order to improve the electrical contact between the train wheels and the rails over which they travel. However, experience indicates that such a low frequency signal applied at an energy level sufficient to overcome the insulating effects of the contaminants is subject to being shunted by train wheels outside of, and distant to, the island section of track where the wetting benefit is required.

Also, the application of a wetting current to the track has been proposed as disclosed in U.S. Pat. No. 5,170,970, issued Dec. 15, 1992. The wetting current is provided by a high-frequency power oscillator that is activated by an existing island circuit and runs continuously while a train is present in the island. The frequency (10 KHz or higher) provides suitable inductive isolation but the frequency generated can create interference problems with other control equipment located at the crossing.

SUMMARY OF THE INVENTION

It is therefore, the primary object of the present invention to provide an improved method and apparatus for detecting the presence of a train within a defined section of track, by ensuring that the electrical contact between a wheel of a railroad train and the rail over which the wheel travels will be maintained so that the shunt effect of the train will be effective and consistent.

As a corollary to the foregoing object, it is an important aim of this invention to provide a method and apparatus for preventing a warning system from deactivating while a train still occupies the defined track section.

Another important object of this invention is to provide such a method and apparatus which utilizes relatively high-voltage pulses applied to the rails, the pulses having a relatively narrow width in order to inductively isolate the pulse source and the applicable stretch of track from wheel/rail contact remote therefrom that might be provided by railroad cars not associated with the track section of concern, and a pulse detector with a relatively high voltage threshold which detects received pulses that exceed the threshold and disables the pulse source when a shunt is not present within the applicable track section.

Also, a specific object of the present invention is to provide time-spaced, narrow pulses for the above purposes by the successive discharge of a capacitor, each pulse having a voltage sufficient to reliably break through films and oxides which may be present on the track and having a duration on the order of 25 microseconds so as to inductively isolate the pulse source and the affected stretch of track.

Another specific object of this invention is to provide a pulse detector for the above purposes having a voltage detection threshold well below the unshunted track voltage but above the shunted track voltage resulting from puncture of the oxides or other unintended insulating materials present between the rails and wheels.

Yet another specific object is to provide such a method and apparatus for use at an island section to ensure proper operation of the crossing warning system, wherein application of the time-spaced electrical pulses is controlled by the pulse detector in conjunction with the warning system so that the system does not deactivate while a train still occupies the island section.

Still another specific object of the invention is to provide such a method and apparatus for use at an island section to ensure proper operation of the crossing warning system, wherein application of the pulses to the track is controlled by the pulse detector in conjunction with the warning system so that the system operates in a fail-safe manner.

Furthermore, it is an overall objective of this invention to provide such a method and apparatus wherein the pulses are not applied to the track at times when the train is not in the island section, and the pulses are of such character so as to not interfere with other electronic track equipment.

Additionally, an overall objective is to provide such a method and apparatus having high immunity to interference from other electronic track equipment.

In a grade crossing warning system provided with the present invention, these and other objects are achieved by applying high-voltage, time-spaced, narrow electrical pulses to the track when a train is detected by the island detection circuit. At a level of approximately 40 volts the pulses readily arc through films and oxides which may be present. The arcing lowers the voltage across the rails to a level below the pulse detector threshold. Wide spacing between successive pulses, such as one second, and an extremely short pulse duration minimize interference with other track equipment. Ease of installation of the apparatus is accomplished by utilizing existing track connection wires and by not requiring any equipment to be installed outside of the control equipment housing.

To prevent the high-voltage pulses from loading by shunt current paths that would be established by wheels and axles outside the island section, a pulse width on the order of 25 microseconds is utilized. This provides inductive isolation due to the impedance characteristic (inductive) of the track and has the effect of localizing the region of influence of pulsed voltage. A greater or lesser pulse duration may be employed depending upon the track impedance at the site.

The pulses are produced by the discharge of an output capacitor of a pulse generator which is controlled by the pulse detector in conjunction with the grade crossing warning system such that the pulse generator will always be deactivated except during the time that a train is actually occupying the island section, and the island detection circuit is deenergized (indicating the presence of a train in the island). The initial detection of a train in the island is accomplished by means in common use today, such as an audio frequency track circuit. Such systems will almost always detect a locomotive passing over the section due to the much higher weight on the wheels, and will thus provide a reliable means of activation. Once activated the pulse generator and detector assume the role of the island detection circuit and continue to operate the crossing warning until the train departs the island section. When the train departs, the pulse level rises to the detector threshold and the island detection circuit is again energized. Once the crossing warning is activated it will not be deactivated in the event of a malfunction of either the pulse generator or pulse detector.

The pulse detector is a receiver that detects, with a threshold of approximately 2 to 5 volts, the pulses produced by the pulse generator after the train clears the island section. Pulses that exceed the threshold level trigger a one-shot within the pulse detector, producing an approximately 250 millisecond pulse from the pulse detector output. The pulse detector output in combination with the island detector output disables the pulse generator and allows the warning system to deactivate, if other conditions are satisfied.

DETAILED DESCRIPTION

Figure 1:
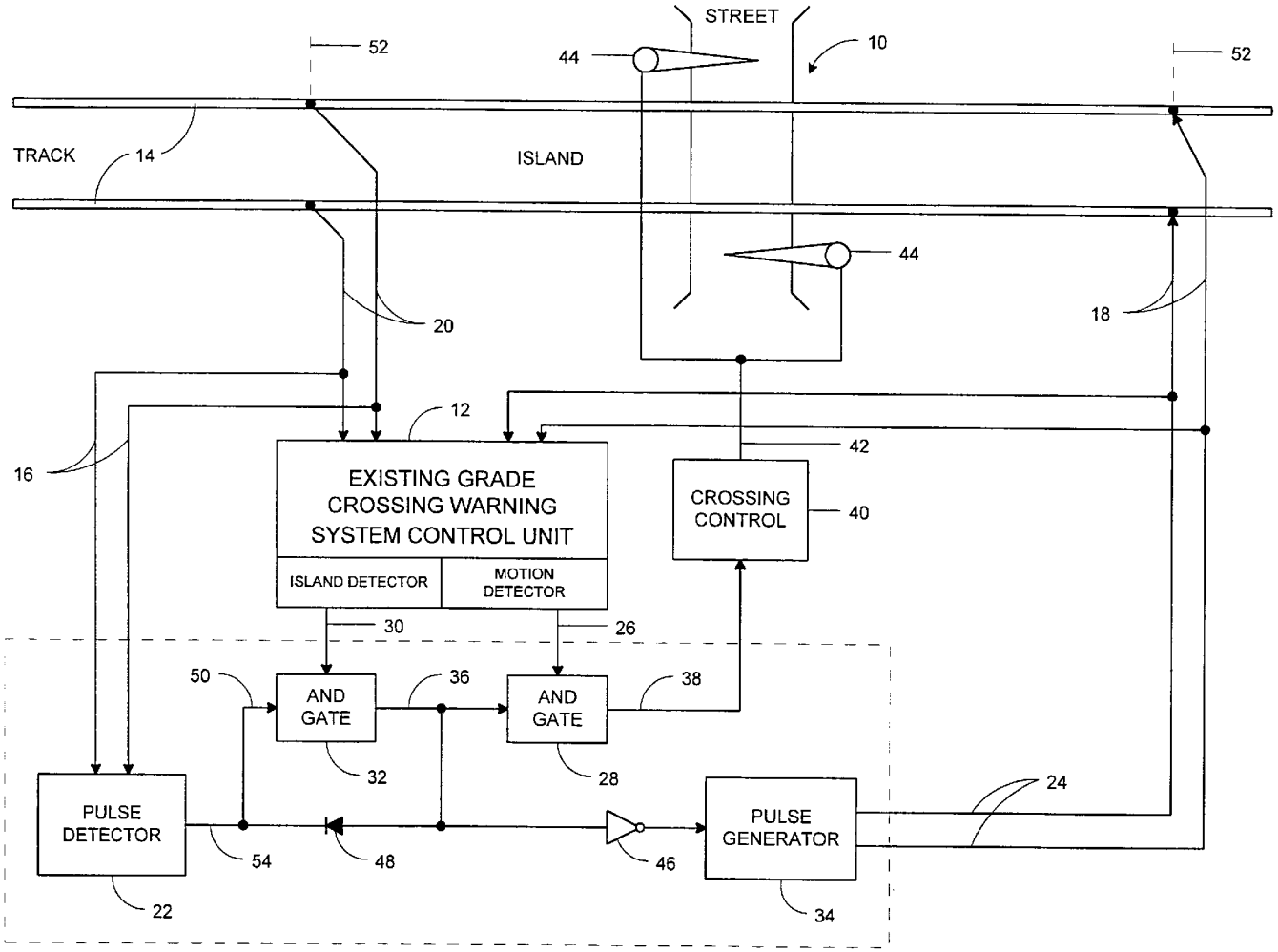
FIG. 1 is a block diagram illustrating the application of the teachings of the present invention to an island section at a grade crossing equipped with a warning system controlled by a motion detector.

FIG. 1 illustrates a grade crossing 10 equipped with a warning system control unit 12 which includes a conventional motion detector for sensing an approaching train and an island detector circuit for maintaining the warning in an activated condition so long as the train is present in the island section of the railroad track. As schematically illustrated, the island section is defined by broken lines 52 spaced from the crossing. A pair of leads 18 connect the motion detector and island transmitters to rails 14 of the track at the right end of the island section (as viewed in FIG. 1), and a second pair of leads 20 connect the motion detector and island receivers to rails 14 at the left end of the island section.

The warning system control unit 12 has a motion detector output 26 which is connected to one input of an AND gate 28. The control unit 12 also has an island detector output 30 which is connected to one input of an AND gate 32. The output 36 of the AND gate 32 is connected to a second input of the AND gate 28, a second input 50 of AND gate 32 via diode 48, and a pulse generator 34 via inverter 46. The output 38 of the AND gate 28 is connected to a crossing control 40 having an output connected via a line 42 to the grade crossing warning system devices located at the crossing, illustrated in FIG. 1 by the two gates 44 shown blocking the street or roadway. It should be noted that such a warning system may also utilize flashing lights only.

A pulse detector 22 is responsive to the voltage level on leads 16 connected via leads 20 to rails 14 at the left end of the island, and delivers an output at 54 from an internal one-shot (not shown) when the received voltage exceeds a preset threshold. As will be discussed, the function of the pulse detector 22 is to receive pulses transmitted along rails 14 and return control to the grade crossing warning system when pulses from the pulse generator 34 of sufficient amplitude are detected.

More specifically, the motion detector output 26 and island detector output 30 are normally at their high logic levels, indicating that a train is not approaching and that a train is not present in the island. Due to logic inversion at inverter 46, the output 36 of AND gate 32 energizes pulse generator 34 only when a low logic level signal is applied to the inverter's input. As AND gate 32 is also connected to one of its own inputs 50 through diode 48, it sticks or latches and continues to produce an output as long as all of its inputs remain high. The output 36 of AND gate 32 is also connected to an input of the AND gate 28. Accordingly, under conditions where no warning is necessary, the high logic level from the output 36 of AND gate 32 and the high logic level from motion detector output 26 maintain the output 38 of AND gate 28 at the high logic level and the main crossing control 40 does not activate the crossing warning.

When an approaching train is detected, the motion detector output 26 goes low, output 38 of AND gate 28 goes low, and the warning is activated causing the warning system 44 to be activated. When the front of the train enters the island section, island detector output 30 goes low causing the output 36 of AND gate 32 to go low. This enables pulse generator 34, via inverter 46, which preferably delivers approximately 40-volt peak, 25 usec. wide pulses every second on output leads 24 which connect to rails 14 at the right end of the island section via the existing grade crossing warning system leads 18. Output 36 of AND gate 32 goes from high to low as the train enters the island circuit, and both motion detector output 26 and island detector output 30 also remain low except during momentary shunting failures. Therefore, the output 38 of AND gate 28 remains unchanged and the warning system 44 remains activated.

When the train is in the island section, the voltage level of the pulse generator output 34 is sufficient to arc through and overcome any anticipatable track film which may exist between the wheel and the rail. The resulting shunt will reduce the voltage below the activation threshold of pulse detector 22, which may be in the range of 2 to 5 volts (a level of 4 volts is preferred).

When the train departs the island section, there is no longer a shunt between the two rails 14 within the island section. Thus the pulse voltage level from pulse generator 34 rises above the threshold of pulse detector 22 and triggers a 250 msec. pulse from the pulse detector 22 one-shot in response to each pulse detected. When the pulse detector output on line 54 goes high, diode 48 prevents the pulse detector output from deactivating pulse generator 34 before island detector output 30 has recovered after the train has left the island section. When the island detector has recovered and output 30 goes high, and when detector 22 receives a pulse exceeding its threshold level, detector 22 delivers an output pulse to gate input 50. Then, the output 36 of AND gate 32 goes high and deactivates pulse generator 34 via inverter 46. Additionally, output 36 in combination with motion detector output 26 which is also high, causes the output 38 of AND gate 28 to go high, thereby deactivating the warning system 44. The return to normal operation (deactivation of the warning system) should be accomplished within two seconds of departure of the train from the island or, for slow or stopped trains, within 50 feet outside the island.

Figure 2:
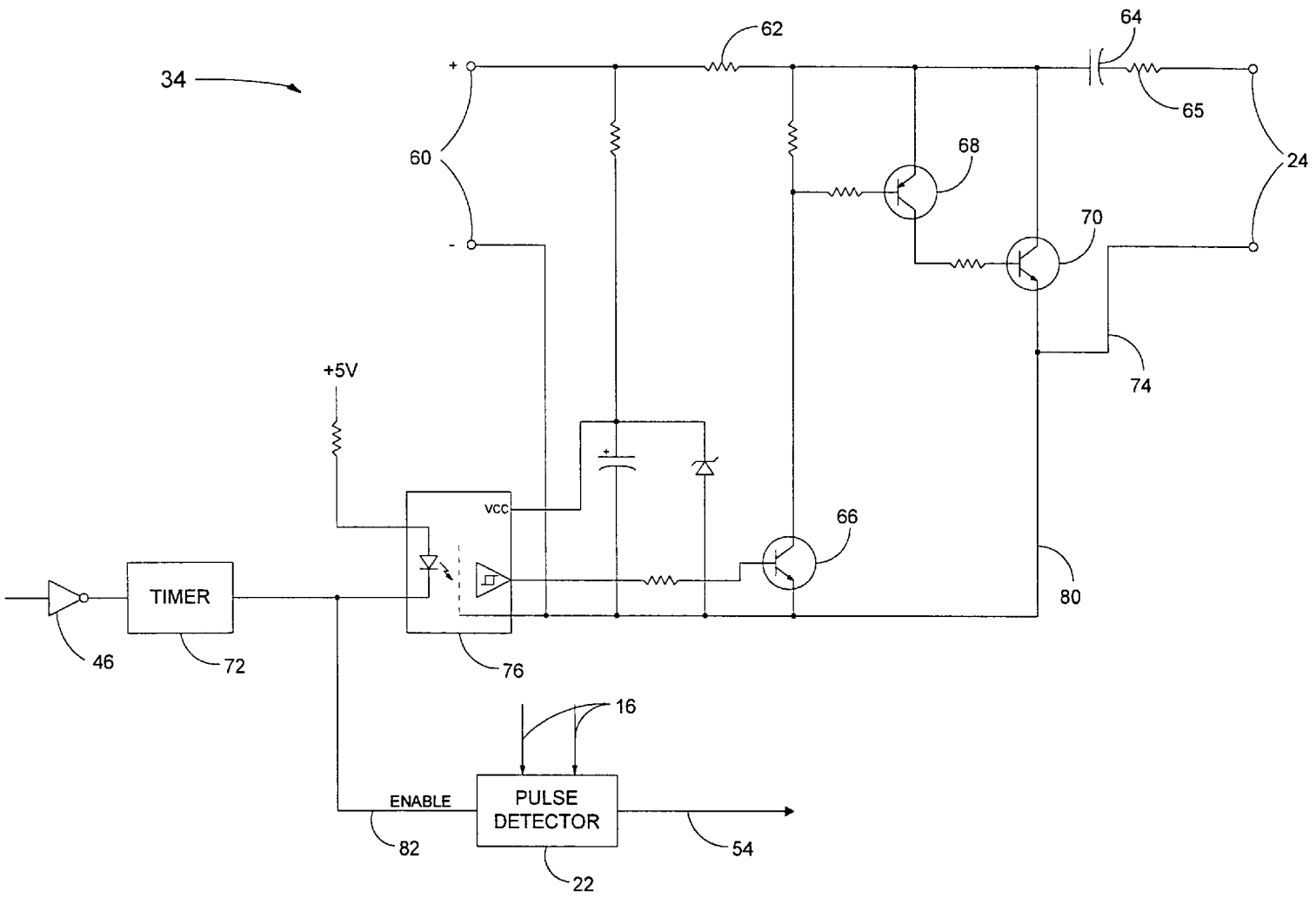
FIG. 2 is a schematic diagram of a portion of the pulse generator and associated components.

The pulse generator 34 is shown in detail in FIG. 2. An isolated direct current power supply (not shown) delivers 51 volts DC to power terminals 60 to which the circuitry of pulse generator 34 is connected. A 100,000 ohm resistor 62 is connected between the positive terminal 60 and one plate of an output capacitor 64, the other plate being connected by a 2 ohm resistor 65 to one of the output leads 24 that extends to a corresponding rail 14 (FIG. 1). A switching circuit utilizing three transistors 66, 68 and 70 controls the charging and discharging of capacitor 64 in response to a timer 72. It should be noted that the emitter-collector circuit of the final switching transistor 70 is connected from the left plate of capacitor 64 (to which resistor 62 is connected) to the other output lead 24 via a connecting lead 74.

The timer 72 delivers a turn-on pulse to an optical isolator 76. Typically, the turn-on pulses would have a duration of 31 usec. and are delivered at one second intervals. Power connections to the isolator 76 are illustrated in FIG. 2.

When timer 72 delivers a turn-on pulse to isolator 76, that pulse is repeated by the isolator and applied to the base of transistor 66 of the switching circuit. Prior to this time during the period between turn-on pulses, the switching transistors 66, 68 and 70 are not in conduction and thus capacitor 64 is charged via a charging circuit extending from the positive power terminal 60 through resistor 62, capacitor 64, resistor 65, across the rails 14 via the track ballast, lead 74, and the common lead 80 that is connected to the negative power terminal 60. In response to the turn-on pulse from timer 72, the transistors 66, 68 and 70 conduct and capacitor 64 is discharged across the rails 14 through resistor 65. In the circuit illustrated and described, this results in the application of a pulse to the rails 14 having an initial amplitude of about 40 volts, followed by a decreasing voltage ramp dependent upon the time constant of the load. Typically, the pulse width at its base is about 25 usec. In contrast to square wave pulses, the capacitor discharge pulses delivered by pulse generator 34 are advantageous in the present invention because the pulse generator under failure would not continually apply voltage to the track.

It should be understood that a pulse height to an unshunted track from about 10 to 100 volts may be employed depending upon the track environment in which the present invention is utilized. Also, if desired, a resistor (not shown) having a value such as 100 ohms may be connected across output leads 24 to set a maximum resistance independent of the track ballast resistance.

At the same time each second the timer 22 delivers a turn-on pulse to isolator 76, the pulse is also applied via lead 82 to an enable input of the pulse detector 22. Accordingly, the detector 22 is only capable of receiving pulses on rails 14 during the 31 usec. window coincident with operation of the pulse generator 34. This precludes the pulse detector 22 from receiving interference originating from other sources that could give a false indication that the train has departed the island.

Also, it should be understood that although a pulse spacing of approximately one second is typical, other spacings may also be utilized depending upon a particular application. A spacing of from about one-tenth of a second to two seconds or more may be utilized depending upon the desired response time and the proximity of other track equipment.

It is to be understood that while a certain form of this invention has been illustrated and described, it is not limited thereto except insofar as such limitations are included in the following claims and allowable equivalents thereof.

Having thus described the invention, what is claimed as new and desired to be secured by Letters Patent is as follows:

1. A method of detecting the presence of a train in a predetermined stretch of railroad track by a shunting effect of wheels and axles of the train, said method comprising the steps of:

connecting a source of high-voltage pulses to rails of the track at connection points in said predetermined stretch of track, connecting a receiver to said predetermined stretch of track for detecting said pulses, shunting across the rails in said stretch of track by contacting said wheels of said train therewith, applying each of said pulses to the rails at said connection points at a sufficiently high voltage level to overcome poor electrical contact between each said wheel and a corresponding one of said rails and with a pulse width of sufficiently short duration to provide inductive isolation of the pulses from adjacent stretches of track, spacing successive applied pulses sufficiently apart to minimize interference with the operations of other track equipment, and ceasing the application of said pulses to the rails when said receiver detects a voltage above a predetermined threshold indicating that the train has departed said predetermined stretch of track.

2. The method as claimed in claim 1, wherein said predetermined stretch of track is an island section, and wherein said step of connecting the pulse source to the rails includes effecting the connection at one end of said island section, whereby to ensure a shunt current path when a train is present.

3. The method as claimed in 2, wherein said step of connecting said receiver to the rails includes effecting the connection at an opposite end of said island section, whereby to ensure pulse detection when a train is not present.

4. The method as claimed in claim 1, wherein said predetermined threshold of the receiver is at least approximately two volts.

5. The method as claimed in claim 1, wherein said voltage level in the step of applying the pulses to the rails is at least approximately ten volts.

6. The method as claimed in claim 1, wherein said pulse width in the step of applying the pulses to the rails is on the order of 25 microseconds.

7. The method as claimed in claim 1, wherein said step of spacing successive applied pulses includes spacing successive pulses approximately one second apart.

8. Apparatus for maintaining an electrical shunt across rails of a railroad track provided by wheels and axles of a train during presence of the train in a predetermined section of track, said apparatus comprising:

a pulse generator for producing time-spaced electrical pulses, means for connecting an output of the generator to the rails at connection points in said predetermined stretch of track within which a shunt current path is to be ensured when a train is present, means responsive to the presence of a train in said predetermined stretch of track for enabling said generator, said generator having means for providing each of said pulses with a voltage sufficient to overcome poor electrical contact between each said wheel and a corresponding one of said rails, and with a pulse width of sufficiently short duration to inductively isolate the pulses from adjacent stretches of track, and detector means for disabling said generator in response to a voltage across the rails in said predetermined stretch of track that exceeds a preset threshold, whereby to assure that the train has departed from said predetermined stretch of track before deactivating the pulse generator.

9. The apparatus as claimed in claim 8, wherein said pulse generator has an output capacitor and operating means for alternately charging and discharging said capacitor to produce said time-spaced pulses.

10. The apparatus as claimed in claim 9, wherein said pulse width is on the order of 25 microseconds.

11. The apparatus as claimed in claim 9, wherein said operating means spaces said pulses at least approximately one-tenth of a second apart.

12. The apparatus as claimed in claim 8, wherein said threshold of said detector means is at least approximately two volts.

13. The apparatus as claimed in claim 8, further comprising means connected with said detector means for enabling the detector means only during operation of the pulse generator.

14. The apparatus as claimed in claim 8, wherein said predetermined stretch of track is an island section.

15. The apparatus as claimed in claim 14, further comprising a grade crossing warning system having an island detector that detects the presence of a train in the island section, and means responsive to said system and connected with said pulse generator for enabling the latter in response to detection of the train by said island detector.

* * * * *

UNITED STATES PATENT AND TRADEMARK OFFICE

CERTIFICATE OF CORRECTION

PATENT NO. : 5,924,652

DATED : July 20, 1999

INVENTOR(S) : Forrest H. Ballinger

It is certified that error appears in the above-identified patent and that said Letters Patent is hereby corrected as shown below:

At [54] in the title, and in column 1, first line, after ISLAND PRESENCE, delete [DETECTED] and substitute --DETECTOR-- therein。

Signed and Sealed this

First Day of February, 2000

*Attest:*

*Attesting Officer*

Q. TODD DICKINSON

*Acting Commissioner of Patents and Trademarks*